US005541391A

United States Patent [19]

Seong

[11] Patent Number: 5,541,391

[45] Date of Patent: Jul. 30, 1996

[54] MICROWAVE OVEN EMPLOYING A KLYSTON

[75] Inventor: Yeon-Hag Seong, Suwon, Rep. of Korea

[73] Assignee: Samsung Electronics Co., Ltd., Suwon, Rep. of Korea

[21] Appl. No.: 250,624

[22] Filed: May 27, 1994

[30] Foreign Application Priority Data

May 27, 1993 [KR] Rep. of Korea ..... 93-9351

[51] Int. Cl.[6] ..... H05B 6/64; H01J 25/10

[52] U.S. Cl. ..... 219/761; 219/757; 315/5.38; 315/39

[58] Field of Search ..... 219/761, 754, 219/751, 757; 315/39, 5.38, 4, 5

[56] References Cited

U.S. PATENT DOCUMENTS

| | | | |
|---|---|---|---|
| 3,665,140 | 5/1972 | White | 219/709 |
| 3,780,251 | 12/1973 | Kee | 219/700 |
| 4,296,297 | 10/1981 | Miller | 219/757 |
| 4,476,362 | 10/1984 | Kusunoki et al. | 219/757 |
| 5,148,129 | 9/1992 | Bolton | 315/39 |

OTHER PUBLICATIONS

McGraw–Hill Encyclopedia of Science & Technology, "Klystron" (vol. 9, pp. 526–530).

*Primary Examiner*—Philip H. Leung
*Attorney, Agent, or Firm*—Burns, Doane, Swecker & Mathis, L.L.P.

[57] ABSTRACT

A microwave oven has a cooking chamber and a microwave generator for supplying microwaves to the cooking chamber. The microwave generator is in the form of a klystron which produces a plurality of electron beams for amplifying microwaves.

18 Claims, 9 Drawing Sheets

FIG. 3
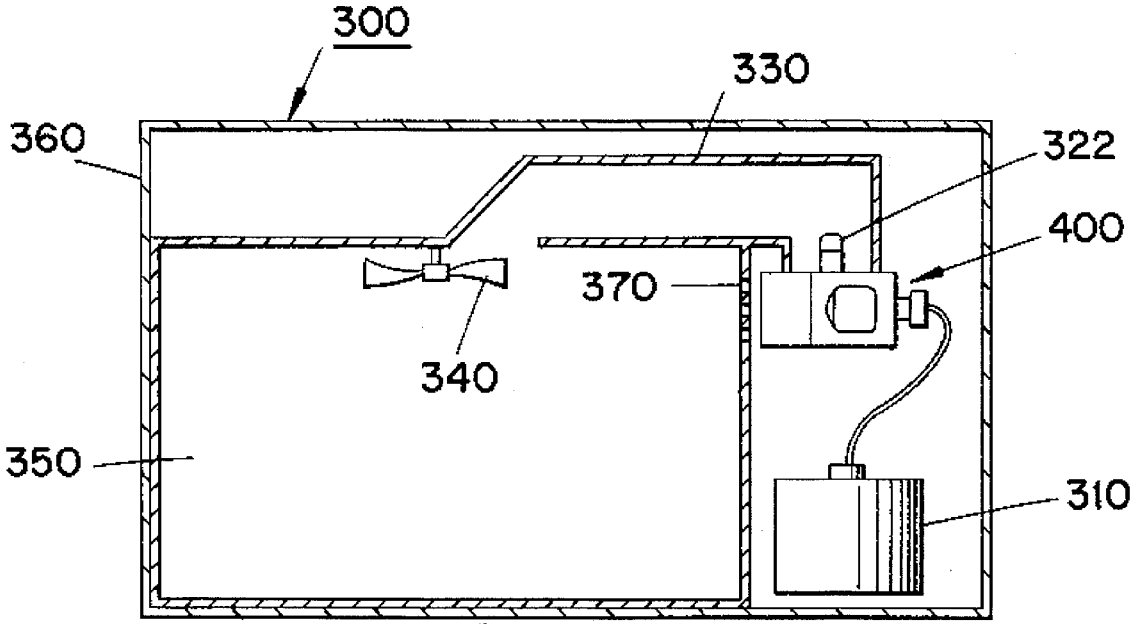
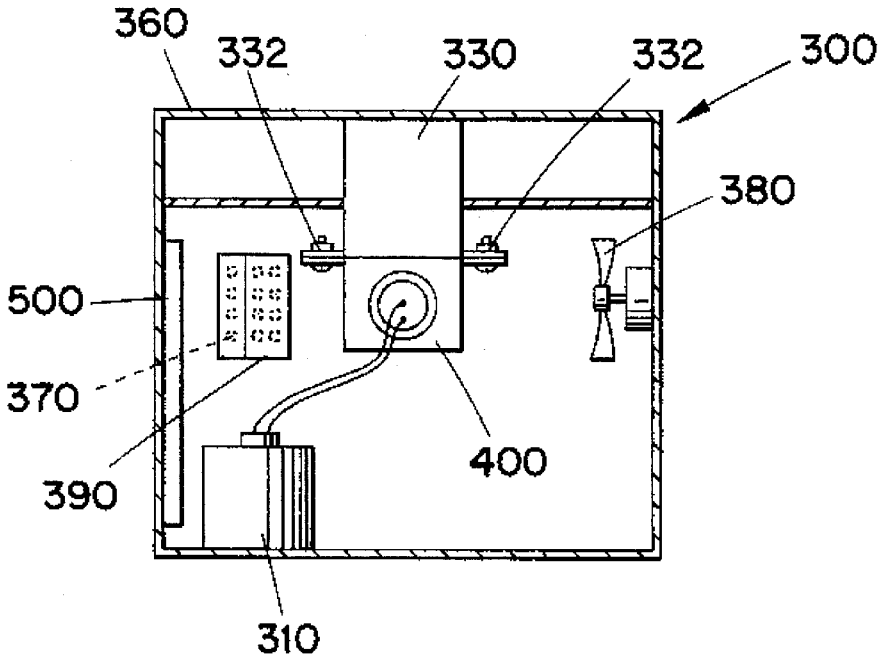
FIG. 4

FIG. 6
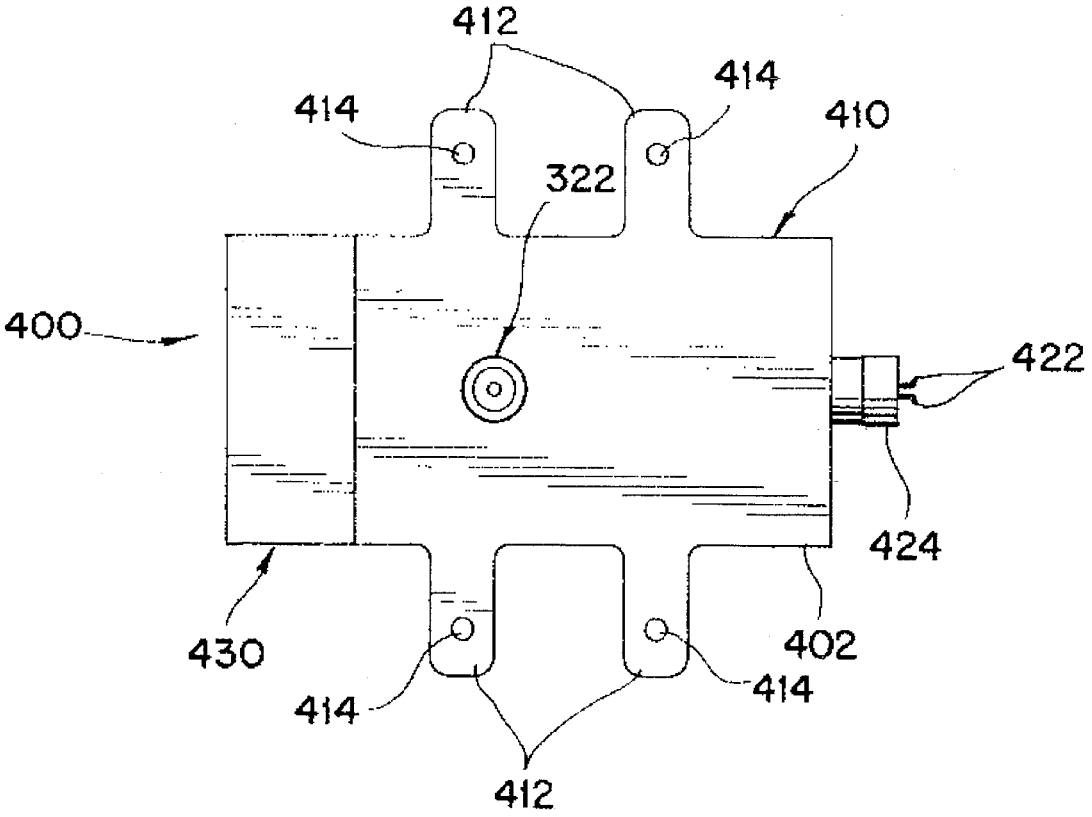
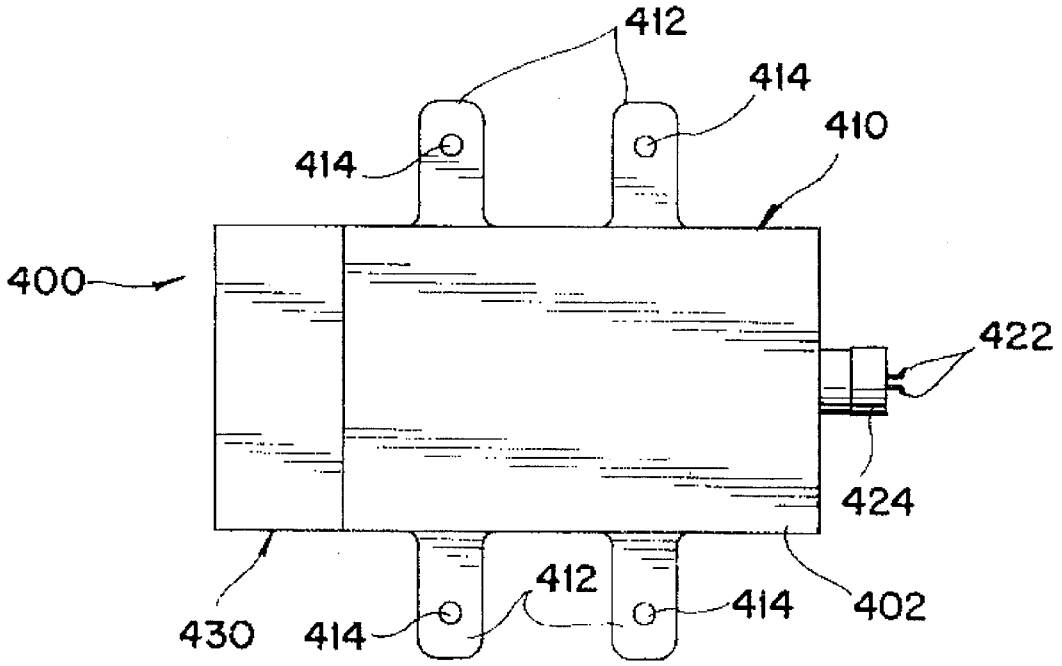
FIG. 7

FIG. 8
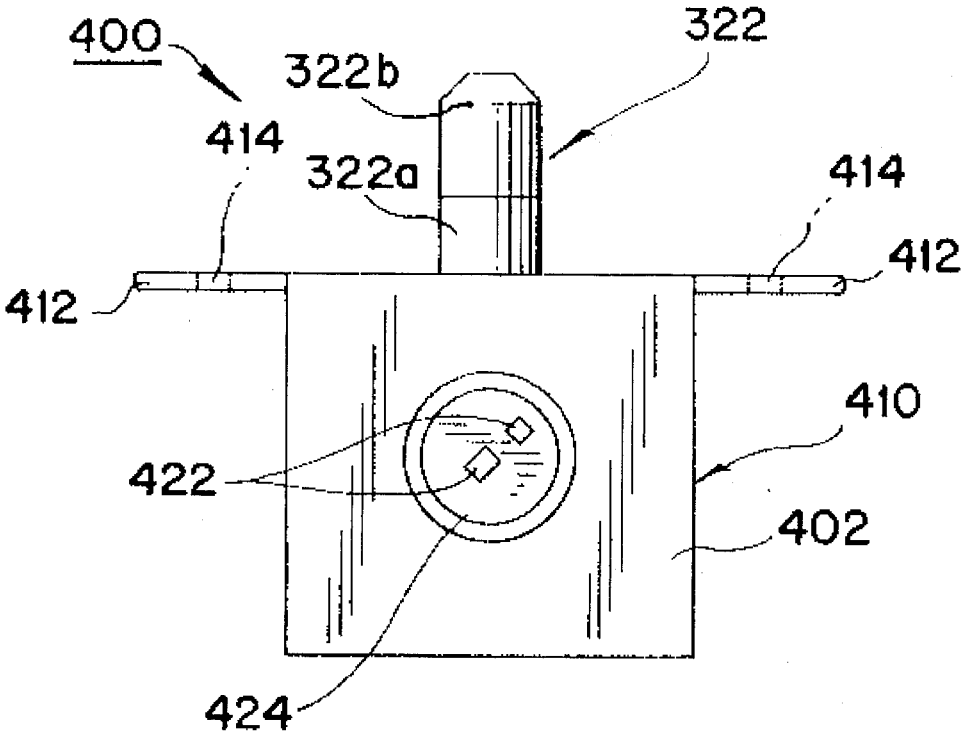
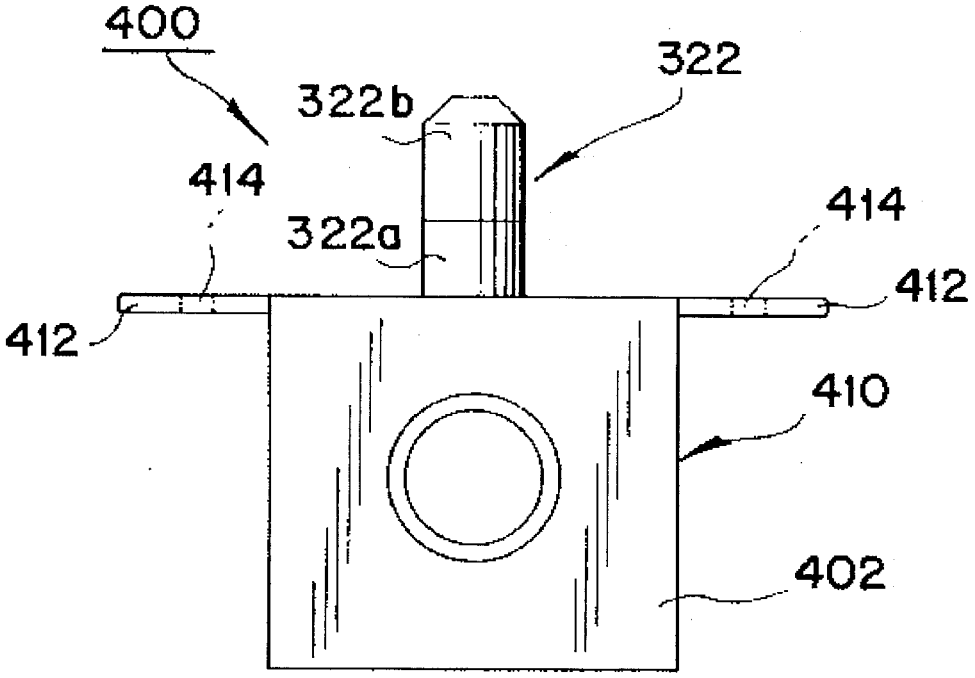
FIG. 9

MICROWAVE OVEN EMPLOYING A KLYSTON

BACKGROUND OF THE INVENTION

1. Field of the Invention

The present invention relates to a microwave oven, and more particularly to a microwave oven employing a klystron for achieving lightness and eliminating a danger due to high voltage.

2. Description of the Prior Art

Typically, microwave ovens employ a magnetron which is energized with a high voltage of, for example, 4 KV. For using such a magnetron, the microwave ovens needs a high voltage transformer which results in a problem in safety, an increase in weight, and an increase in manufacture cost.

An example of such a microwave oven employing the magnetron is illustrated in FIG. 1.

In FIG. 1, the reference numeral 10 denotes a power supply unit including a high voltage transformer and a high voltage condenser. As a user manipulates a control panel (not shown) arranged at the right portion of a front surface of the microwave oven, the power supply unit supplies electric power to a magnetron denoted by the reference numeral 20 in FIG. 1 and a cooling fan not shown. The magnetron 20 is activated upon receiving a high voltage of 4 KV from the power supply unit 10. At the activated state, the magnetron 20 emits microwaves via an antenna 22. The microwaves emitted from the antenna 22 of magnetron 20 are guided to a cooking chamber 50 via a wave guide 30 and then spread in the cooking chamber 50 by a stirrer 40. The spread microwaves are incident on a food contained in the cooking chamber 50, so that cooking can be carried out.

On the other hand, the cooling fan (not shown) is typically arranged behind the magnetron 20 when viewed in FIG. 1. The cooling fan generates wind for cooling the magnetron 20. As the wind cools the magnetron 20, the wind increases in temperature. The heated wind is guided to an inlet 70 by a duct (not shown) so that it can be introduced into the cooking chamber 50.

The inlet 70 is constituted by at least one aperture having a diameter l less than ¼ of the wavelength λ of microwaves ($l<\lambda/4$) so as to prevent the incident microwaves from being leaked through the aperture.

In FIG. 1, the reference numeral 60 denotes a housing as an enclosure of the microwave oven.

FIG. 2 is a sectional view illustrating the magnetron 20 of the microwave oven shown in FIG. 1. As shown in FIG. 2, the magnetron 20 is a cylindrical bi-pole vacuum tube. At the center of magnetron 20, a cathode 22 is arranged. When an operating voltage is applied to an input terminal 21, the cathode 22 is heated to emit electrons. Arranged around the cathode 22 is an anode 23 which receives electrons emitted from the cathode 22.

A pair of cylindrical magnets 24*a* and 24*b* are disposed above and beneath the magnetron 20. The magnets 24*a* and 24*b* generate magnetic fluxes which are, in turn, guided by guide members 25*a* and 25*b* to pass through a cavity 26 defined between the cathode 22 and anode 23 and kept in vacuum.

Accordingly, the electrons emitted from the cathode 22 are deviated by a magnetic field formed in the cavity 26, so that they may revolve between the cathode 22 and the anode 23.

Where a lot of electrons revolves in groups in the cavity 26, a resonance circuit is constructed in the anode 23. By this resonance circuit, microwaves are generated. The anode 23 which is increased in temperature due to impact among electrons is cooled by cooling fins 29. The microwaves are outputted at the antenna 27 connected at one end to the anode 23.

The antenna 27 is protrudes upwards through a hole centrally provided in the upper magnet 24*a* . The protruded portion of antenna 27 is capped with a cap 28. That is, the cap 28 is mounted to surround the antenna 27.

The microwaves, namely, radio frequency waves emitted from the antenna 27 reach the cooking chamber via the wave guide and the inlet both typically equipped in conventional microwave ovens and then heat the food contained in the cooking chamber.

However, since a high voltage of about 4 KV should be applied between the cathode 22 and the anode 23 in the magnetron having the above-mentioned construction, the conventional microwave oven encounters a problem in safety. Moreover a heavy transformer and condenser are required for generating the high voltage. As a result, the conventional microwave oven is bulky and heavy. In addition, an increase in manufacture cost is involved.

SUMMARY OF THE INVENTION

Therefore, an object of the invention is to solve the above-mentioned problems encountered in the prior art and, thus, to provide a microwave oven capable of employing a low voltage oscillation tube, thereby eliminating a danger involved in use of high voltage and obtaining a light construction.

In accordance with the present invention, this object can be accomplished by providing a microwave oven comprising: a klystron for receiving an electric power and thereby generating microwaves; a cooking chamber for receiving the microwaves and performing a cooking for a food by use of the received microwaves; and control means for controlling the klystron under a control of a user.

BRIEF DESCRIPTION OF THE DRAWINGS

Other objects and aspects of the invention will become apparent from the following description of embodiments with reference to the accompanying drawings in which:

FIG. 3 is a schematic view illustrating a microwave oven in accordance with an embodiment of the present invention;

FIG. 4 is a side view of the microwave oven shown in FIG. 3;

FIG. 6 is a plan view of the klystron shown in FIG. 5;

FIG. 7 is a bottom view of the klystron shown in FIG. 5;

FIG. 8 is a right side view of the klystron shown in FIG. 5;

FIG. 9 is a left side view of the klystron shown in FIG. 5;

DETAILED DESCRIPTION OF THE PREFERRED EMBODIMENTS

Figure 1:
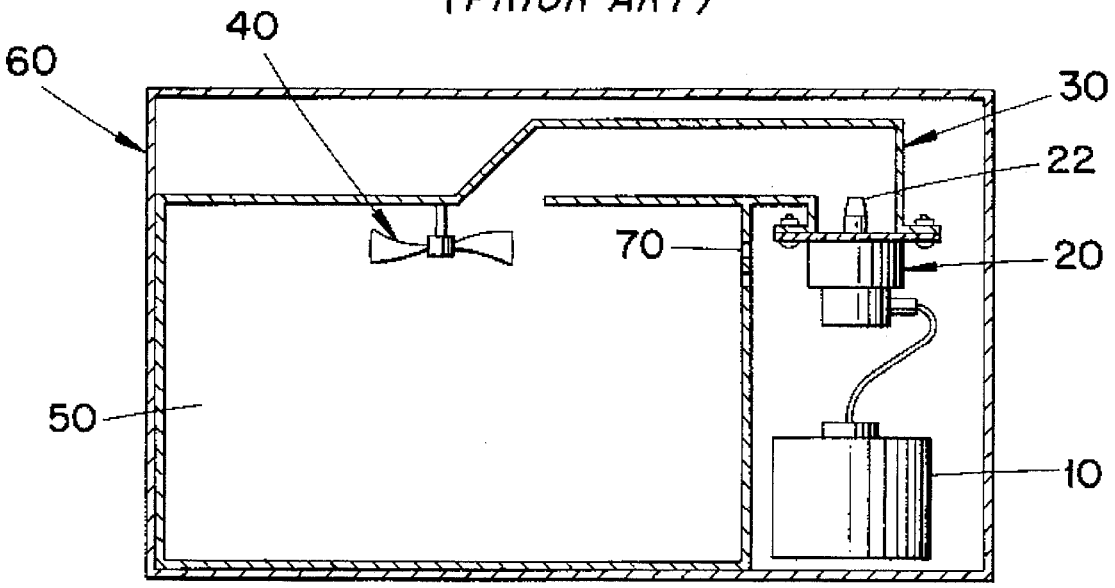
FIG. 1 (PRIOR ART)
FIG. 1 is a schematic view illustrating a conventional microwave oven.
Figure 2:
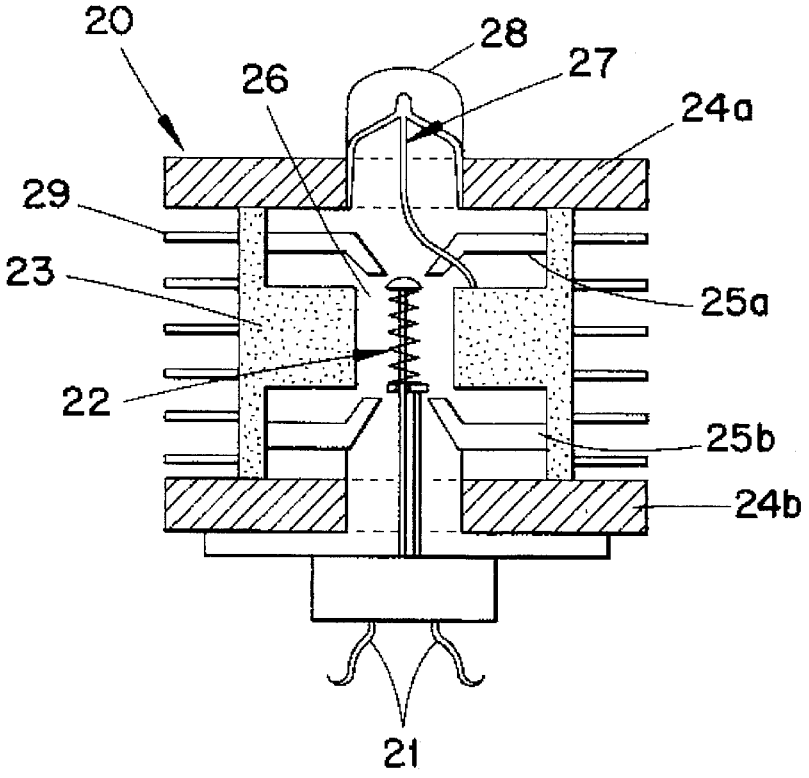
FIG. 2 (PRIOR ART)
FIG. 2 is a sectional view illustrating a magnetron of the microwave oven shown in FIG. 1.

Referring to FIGS. 3 to 14, there is illustrated a microwave oven in accordance with an embodiment Of the present invention.

FIG. 3 is a schematic view illustrating the microwave oven in accordance with the embodiment of the present invention. In FIG. 3, the microwave oven is denoted by the reference numeral 300. FIG. 4 is a side view of the microwave oven 300 shown in FIG. 3.

In FIGS. 3 and 4, the reference numeral 310 denotes a power supply unit. As a user manipulates a control panel 500 arranged at the right portion of front surface of the microwave oven, the power supply unit 310 supplies electric power to a klystron 400 and a cooling fan 380. The klystron 400 is activated upon receiving an operating voltage from the power supply unit 310. At the activated state, the klystron 400 emits microwaves via an antenna 322. The microwaves emitted from the antenna 322 of klystron 400 are guided to a cooking chamber 350 via a wave guide 330. The microwaves introduced are spread in the cooking chamber 350 by a stirrer 340, to be incident on a food contained in the cooking chamber 350, so that cooking can be carried out.

On the other hand, the cooling fan 380 is arranged behind the klystron 400 when viewed in FIG. 4. The cooling fan 380 generates wind for cooling the klystron 400. As the wind cools the klystron 400, it increases in temperature. The heated wind is guided to an inlet 370 by a duct 390 so that it can be introduced into the cooking chamber 350.

The inlet 370 is constituted by at least one aperture having a diameter l less than ¼ of the wavelength λ of microwaves ($l<\lambda/4$) so as to prevent the incident microwaves from being leaked through the aperture.

In FIGS. 3 and 4, the reference numeral 332 denotes a mounting member for fixedly mounting the klystron 400 to the wave guide 330 and the reference numeral 360 denotes a housing as an enclosure of the microwave oven.

Figure 5:
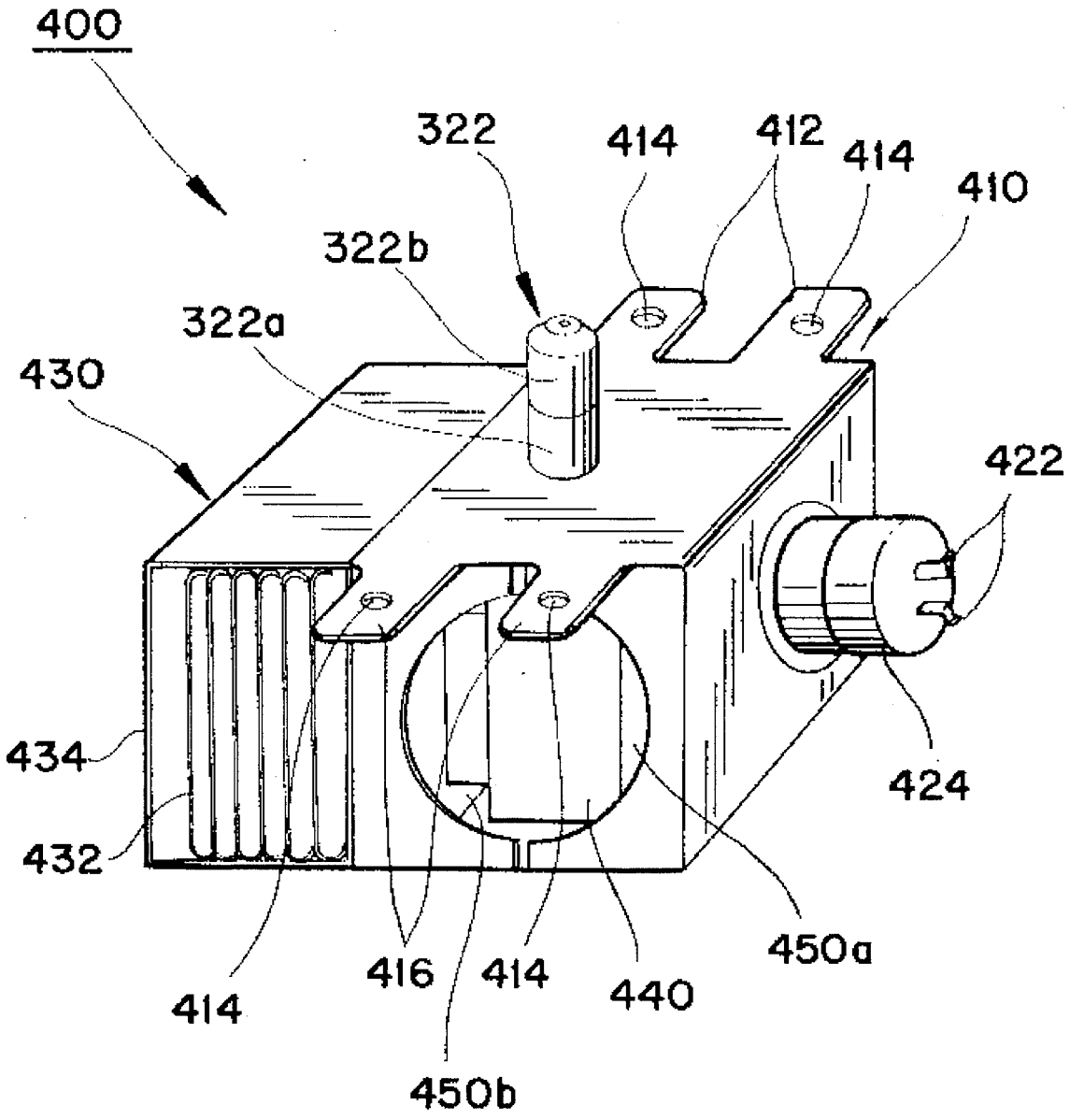
FIG. 5 is a perspective view illustrating a klystron employed in the microwave oven shown in FIG, 3 in accordance with the present invention.

FIG. 5 is a perspective view illustrating the klystron 400 employed in the microwave oven shown in FIGS. 3 and 4 in accordance with the present invention.

As shown in FIG. 5, the klystron 400 includes an input terminal 422 for receiving an electric power, a klystron body 410 for generating an energy, namely, a microwave of a certain frequency upon receiving the electric power via the input terminal 422, an antenna 322 for transmitting the energy from the klystron body 410 to an external unit (in the illustrated case, the wave guide 330 of FIGS. 3 and 4), and a cooling unit 430 for cooling the klystron body 410.

The input terminal 422 is electrically insulated from the klystron body 410 by an insulator 424.

The klystron body 410 includes a yoke 402 as an enclosure, a pair of spaced magnets 450*a* and 450*b* disposed in the yoke 402, and a tube 440 interposed between the magnets 450*a* and 450*b*.

A plurality of clamping pieces 412 are protrude from opposite edges of the upper portion of klystron body 410. Each of the clamping pieces 412 has a clamping hole 414. It is preferred that the clamping pieces 412 are positioned to balance the weight of klystron 400.

The antenna 322 protrudes upwards from the klystron body 410 and includes a coaxial line which will be described hereinafter, an insulating member 322*a* and a cap 322*b*. The insulating member 322*a* is made of an insulator such as ceramic for providing an insulation from the yoke 402 of klystron body 410. The cap 322*b* is made of a material such as stainless steel.

The cooling unit 430 includes a plurality of cooling fins 432 for dispersing heat generated from the klystron body 410, a cooling rod 436 for transferring the heat from the klystron body 410 to the cooling fins 432, and a cooling member 434 surrounding the cooling fins 432 and constituting an enclosure of the cooling unit 430.

FIG. 6 is a plan view of the klystron 400 shown in FIG. 5. FIG. 7 is a bottom view of the klystron 400. On the other hand, FIGS. 8 and 9 are a right side view and a left side view respectively illustrating the klystron 400. As shown in FIGS. 6 to 9, the input terminal 422 is arranged at the right side portion of the klystron 400. The input terminal 422 is electrically insulated from the yoke 402 constituting the enclosure of the klystron body 410. As mentioned above, the clamping pieces 412 each having a clamping hole 414 protrude from opposite edges of the upper portion of klystron body 410 and are preferably positioned to balance the weight of klystron 400. The antenna 322 protruding upwards from the klystron body 410 includes the insulating member 322*a* and the cap 322*b*.

The cooling unit 430 is disposed at the left side portion of klystron body 410.

Figure 10:
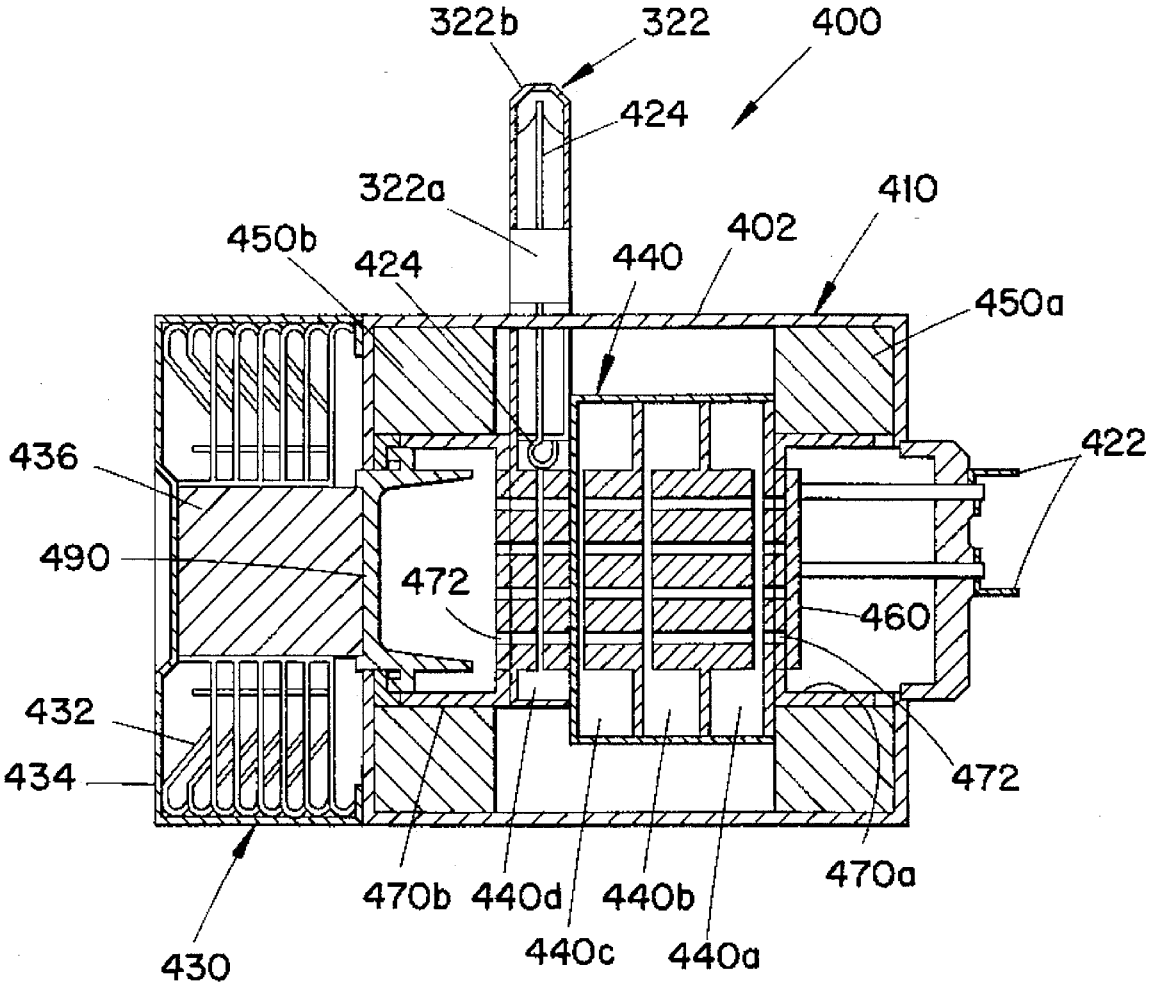
FIG. 10 is a sectional view illustrating an inner construction of the klystron employed in the microwave oven in accordance with the present invention.

FIG. 10 is a sectional view of the klystron 400 employed in the microwave oven in accordance with the embodiment of the present invention.

As mentioned above in conjunction with FIG. 5, the klystron 400 includes the input terminal 422 adapted to receive an electric power, the klystron body 410 for generating energy, namely, microwaves of a certain frequency upon receiving the electric power via the input terminal 422, the antenna 322 adapted to transmit the energy from the klystron body 410 to the external unit (in the illustrated case, the wave guide 330 of FIGS. 3 and 4), and the cooling unit 430 adapted to cool the klystron body 410.

As shown in FIG. 10, the klystron body 410 includes an electron gun 460 for receiving the electric power via the input terminal 422 and generating electrons by the received electric power, a tube 440 having a plurality of cavities (preferably, two to eight in number and, in the illustrated case, four cavities 440*a* to 440*d*) and a plurality of channels which will be described hereinafter, and an anode, namely, collector 490 for collecting electrons emerged from the tube 440. Around the electron gun 460 and the collector 490, a pair of magnets 450*a* and 450*b* are disposed, respectively. The magnets 450*a* and 450*b* serve to maintain the orientation of electrons toward the collector 490 and the moving center of beams of electrons. The klystron body 410 further includes a pair of pole pieces 470*a* and 470*b* for guiding magnetic fluxes generated from the magnets 450*a* and 450*b* to the interior of tube 440 and uniformly distributing the magnetic fluxes in the tube 440, and a yoke 402 serving as a guide for constituting a closed loop by the magnets 450 and 450*b*, the pole pieces 470*a* and 470*b*, the tube 440 and the magnetic fluxes.

The magnets 450*a* and 450*b* are arranged such that the directions of magnetization thereof are oriented axially, namely, perpendicular to the facing surfaces thereof. Alternatively, the magnets 450*a* and 450*b* may be arranged such that the directions of magnetization thereof are oriented radially. In the latter case, one of the magnets 450*a* and 450*b* would have a magnetization direction oriented radially inwardly whereas the other magnet would have a magnetization direction oriented radially outwardly.

As mentioned above, the antenna 322 includes the coaxial line 424, the insulating member 322*a* and the cap 322*b*. The coaxial line 424 has a loop coupling 424*a* disposed in the cavity 440*d* of tube 440. The loop coupling 424*a* receives microwave energy from a magnetic field formed in the cavity 440*d*.

The insulating member 322*a* is made of an insulator such as ceramic for providing an insulation from the yoke 402 of klystron body 410. The cap 322*b* is made of a material such as stainless steel.

As mentioned above, the cooling unit 430 includes the cooling fins 432 which are adapted to disperse heat generated from the collector 490 of klystron body 410, the cooling rod 436 which is adapted to support the cooling fins 432 and transfer the heat from the collector 490 to the cooling fins 432, and the cooling member 434 which is disposed to surround the cooling fins 432 and adapted to constitute the enclosure of cooling unit 430. The cooling rod 436 is brazed to the collector 490 so as to be integral with the collector 490.

In order to reduce electrons reflected by the collector 490, a material, such as molybdenum, exhibiting a high work function may be coated on the collector 490. Alternatively, the collector 490 may have its center positioned apart from the tube 440 whereas its periphery is positioned adjacent to the tube 440. Preferably, the tube 440 is made of copper for inhibiting a chemical reaction thereon.

It is also preferred that the opposite end portions of tube 440 respectively positioned adjacent to the electron gun 460 and the collector 490 are made of a magnetic material, in order to uniformly maintain the magnetic flux density of tube 440. In this case, the magnetic bodies are coated with copper so as to prevent a corrosion thereof and maintain a vacuum characteristic thereof.

Figure 11:
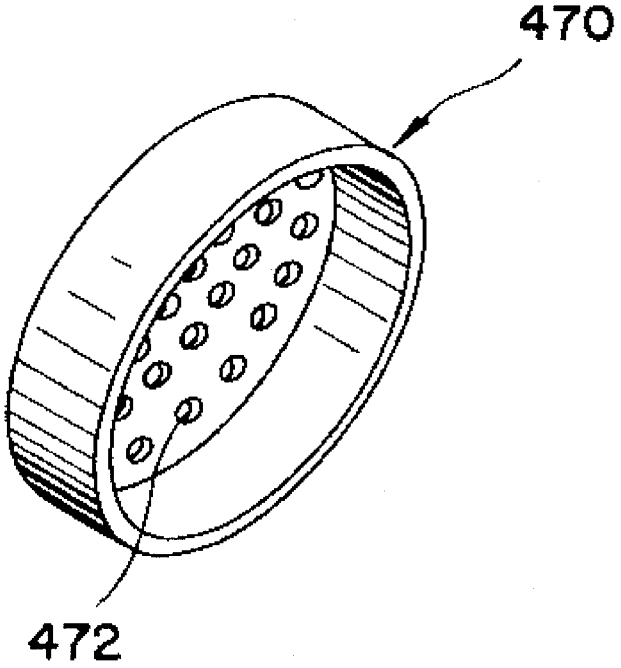
FIG. 11 is a perspective view illustrating a pole piece of the klystron employed in the microwave oven in accordance with the present invention.

FIG. 11 is a perspective view illustrating one of the pole pieces 470*a* and 470*b* of the klystron 400 employed in the microwave oven 300 in accordance with the present invention. In FIG. 11, the pole piece is denoted by the reference numeral 470. The pole piece 470 has a cylindrical construction having a blind end. At the blind end of pole piece 470, a plurality of apertures 472 are provided. These apertures 472 constitute drift channels for passing electron beams therethrough, as will be described hereinafter.

Figure 12:
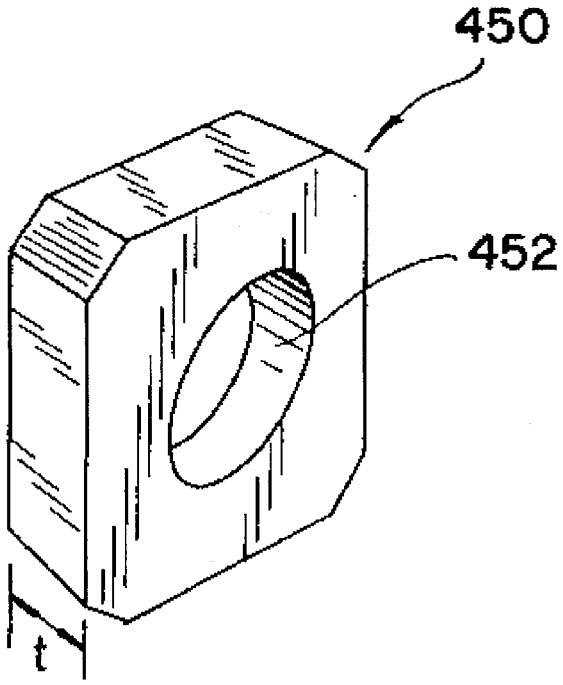
FIG. 12 is a perspective view illustrating a magnet of the klystron employed in the microwave oven in accordance with the present invention.

FIG. 12 is a perspective view illustrating one of the magnets 450*a* and 450*b* of the klystron 400 employed in the microwave oven 300 in accordance with the present invention. In FIG. 12, the magnet is denoted by the reference numeral 450. The magnet 450 has a polygonal construction having a predetermined thickness t. A circular hole 452 is centrally provided at the magnet 450. In the central hole 452, the pole piece 470 is fitted, as shown in FIG. 10. A magnet 450 is arranged around the electron gun 460 and;the collector 490.

Figure 13:
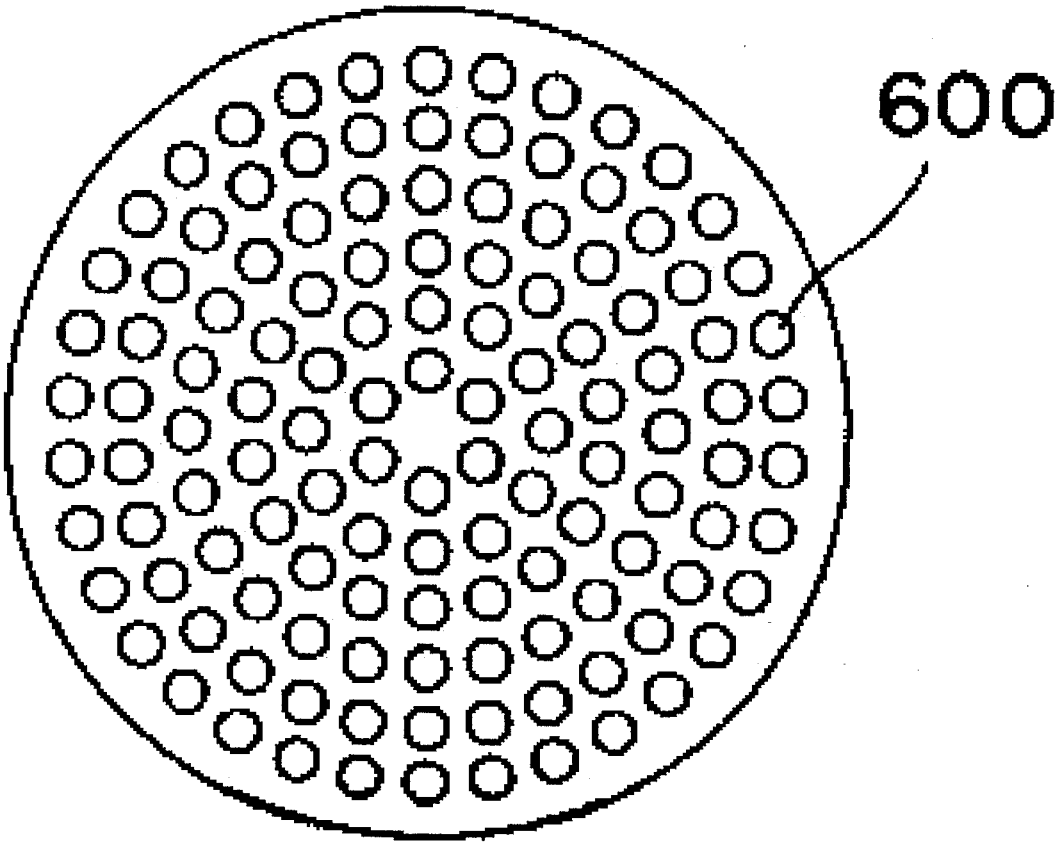
FIG. 13 is a plan view illustrating drift channels of the klystron employed in the microwave oven in accordance with the present invention.

FIG. 13 is a plan view illustrating the drift channels of the klystron 400 employed in the microwave oven 300 in accordance with the present invention. In FIG. 13, the drift channels are denoted by the reference numeral 600. The drift channels 600 are passages for passing beams of electrons generated from the electron gun 460 therethrough. The drift channels 600 extend along the pole piece 470*a*, the tube 440 and the pole piece 470*b*. Preferably, each drift channel 600 has a diameter of 0.3 mm to 5 mm.

Figure 14:
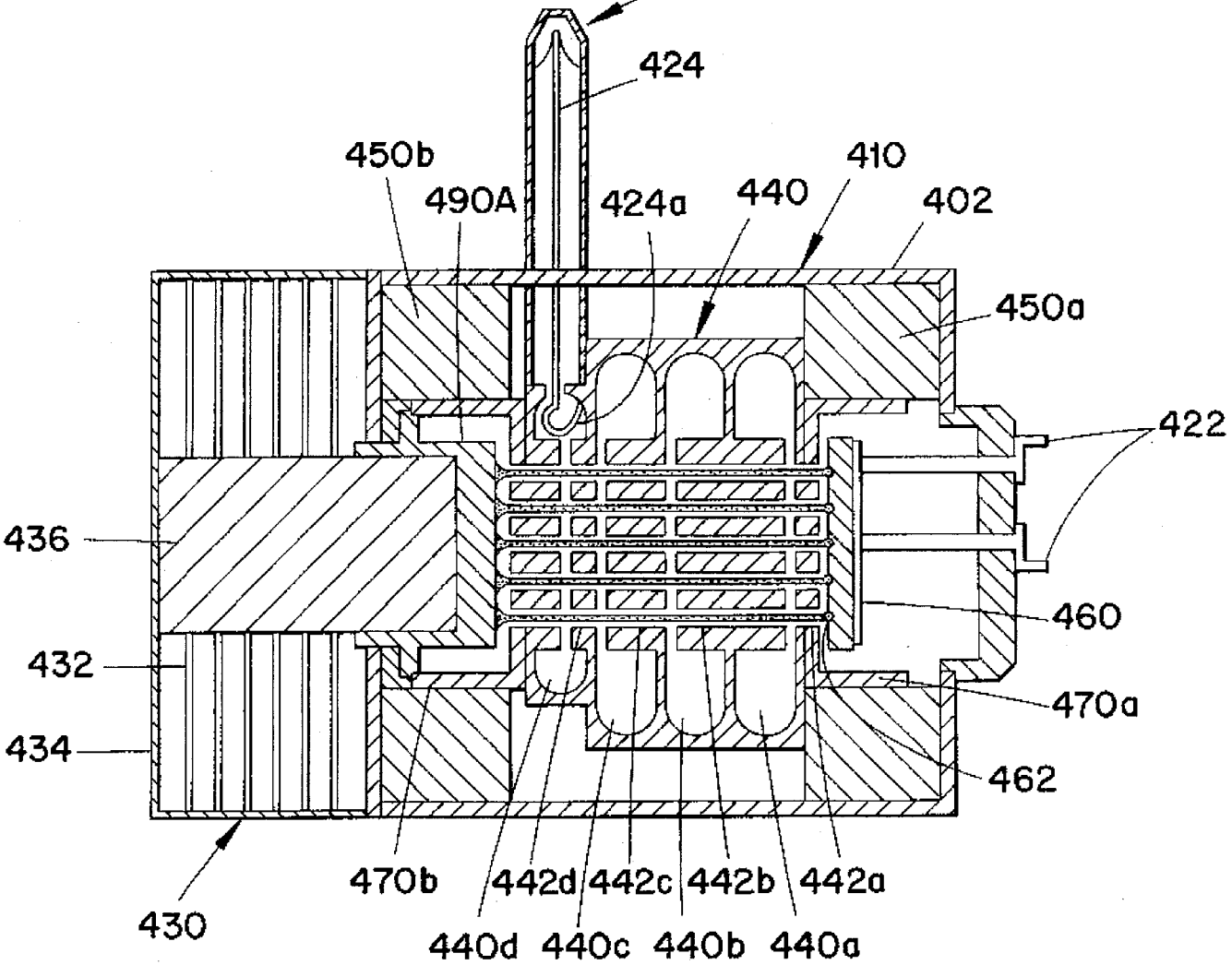
FIG. 14 is a sectional view explaining an operation principle of the klystron employed in the microwave oven in accordance with the present invention.

FIG. 14 is a sectional view explaining an operation principle of the klystron 400 employed in the microwave oven 300 in accordance with the present invention.

As an electric power is applied to the input terminal 422 of klystron 400, hot electrons are generated from the electron gun 460 and concentrated on points, thereby producing electron beams 462. These electron beams 462 are then accelerated at a velocity of v by the potential difference V0 between the electron gun 460 and the collector 490. The velocity v corresponds to $(2eV0/m)^{1/2}$ that is $5.93\times 10^5(V0)^{1/2}$ m/s Electrons traveling through first passage segments 442*a* of the drift channels 600 at different times have different velocities in the drift channels 600 because the pattern of the electric field in that channel segment varies with time. On the basis of this fact, electrons leaving the first channel segments 442*a* can catch up with electrons having previously left, at a lower velocity than an average velocity, the channel segments 442*b*, 442*c* and 442*d* positioned at downstream of the first channel segments 442*a*. As a result, groups of electrons are formed in the electron beams 462.

Meanwhile, the first cavity 440*a* is kept at a predetermined DC voltage level. The first channel segments 442*a* communicating with the first cavity 440*a* maintain a short circuit state at one end thereof and a connected state at the other end thereof at the point of time just before an electron group is introduced therein.

The value obtained by integrating electric fields present among the channel segments 442*a* to 442*d* has the form of a voltage of $V.e^{j\omega t}$. By this voltage, the electrons forming electron beams are accelerated and decelerated as they pass through the channel segments 442*a* to 442d.

This phenomenon is called a velocity modulation. The periodical variation in voltage at the channel segments 442*a* to 442*d* means a periodical variation in velocity of electrons constituting the electron beams 462. On the basis of the velocity, the electron beams 462 are bunched into electron groups. When the electrons bunched by the velocity modulation in the first cavity 440*a* reach the next channel segments 442*b* kept at a voltage of $V.e^{j\omega t}$ bunching of the electron beams occurs more intensively by the coaction between the electron beams and the channel segments 442*b*. At this time, the groups of electrons densely gathered have high energy whereas the groups of electrons thinly gathered have low energy.

Now, a kinetic phenomenon of electrons generating the electron beams 462 will be described. Although the electrons introduced into the tube 440 move at a constant velocity, the electron beams 462 tend to be diffused in the tube 440. This is because a repulsion occurs among a lot of electrons present in the tube 440. As the electron beams 462 are diffused, they strike against the wall of tube 440, thereby causing the kinetic energy of electrons to be consumed in the form of thermal energy.

In order to inhibit such a phenomenon, an electromagnetic field is applied to the spaces through which the electron beams 462 pass. For forming the electromagnetic field in the electron beam-passing spaces, the magnet system is provided in the klystron 400.

The magnet system includes the following four parts.

1) Magnets 450*a* and 450*b* which are permanent magnets and serves as a magnetic flux source, 2) Pole pieces 470*a* and 470*b* which is adapted to guide magnetic fluxes generated from the magnets 450*a* and 450*b* to the spaces where the electron beams 462 are present and force the magnetic fluxes to be uniformly distributed in the channels of tube 440, 3) Channels of tube 440 which are spaces where the electron beams 462 are present and should be maintained at a predetermined magnetic flux density, and 4) Yoke 402 which serves as a guide for obtaining a closed magnetic flux loop.

As the above four parts constitute a magnetic circuit, the electron beam-passing spaces are maintained at a uniform and proper magnetic flux density.

The above-mentioned construction is very advantageous for a decrease in volume because it enables the magnet system to be simplified.

Factors of determining an electromagnetic field include the electromagnetic field, the perveance, the radius of electron beam and the number of electron beams. Magnetic flux density B in a multi-beam klystron can be expressed by the following equation:

$$B=\{(\tfrac{1}{2}rb)(\mu P\times V0/N)\}^{1/2}$$

where, "rb" represents the radius of electron beam, "μP" the micro-perveance, "V0" the drive voltage between the electron gun 460 and the collector 490, and "N" the number of electron beams.

Where a single beam klystron is employed, a required magnetic flux density is about 14,082 Gauss. This vale corresponds substantially to 12 times that required where the multi-beam klystron is employed.

When the electromagnetic field generated by the above-mentioned magnet system is applied such that its applied direction corresponds to the travel direction of electron beams 462, constantly advancing electrons move without being subjected to any force. However, electrons tending to be diffused radially outwardly are subjected to a tangential force, so that they may advance while spirally moving. Consequently, the diffusion of electron beam 462 is inhibited.

The electron beams 462 advancing in the above-mentioned manner then reach the first cavity 440*a*. As electron waves with small energy are inputted or fed back from external or other cavity into the first cavity 440*a*, the electrons are modulated in velocity due to the electron waves applied thereto.

The velocity modulation is determined by the time taken for the electrons to pass the first cavity 440*a* and the intensity of electromagnetic field of the electron waves present in the channel segments 442*a* of the first cavity 440*a*. The intensity of electromagnetic field varies in accordance with a sine function. The number of incident electrons varies at a certain rate. Accordingly, the bunching cycle of electrons accords with the cycle of electron waves.

Therefore, electron beams emerging from the first cavity 440*a* have a non-uniform electron density. Although they take a more or less bunched form, it is insufficient to obtain an satisfactory output energy with such a bunched form. For enhancing the electron density, the above procedure, therefore, is required to be repeated.

In other words, at the moment a group of electrons more or less bunched reach the second cavity 440*b*, leading electrons of the electron group lose their energy which is, in turn, transferred to electrons following the leading electrons. As a result, the electron group has a more increased density.

This result may be obtained in the third cavity 440*c*. As a result, a sufficient bunching can be obtained.

As the electron beams 462 subjected to repeated bunching actions reach the fourth cavity 440*d*, an induction current is generated. Such an induction current is repeatedly generated in the above-mentioned manner as groups of electrons subjected to the bunching action are sequentially introduced in the fourth cavity 440*d*.

The induction current serves to induce and distribute an electromagnetic field in the opposite wide spaces of each of the cavities 440*a* to 440*d*. In the channel segments 442*a* to 442*d*, the induction current serves to exert a repeated action for alternating the electromagnetic field.

The energy of electron waves (in the illustrated case, electron waves having a frequency f of about 2,450 MHz) can be externally outputted from the fourth cavity 440*d* via the coaxial line 424 which has the loop coupling 424*a* electrically connected to the electromagnetic field in the fourth cavity 440*d*.

On the other hand, the charge density of each electron group should be increased for obtaining a high power electron wave energy. However, such an increase in charge density results in a great increase in repulsion among electrons. It, therefore, is required to an increase in magnetic flux density and an increase in voltage both corresponding to the increased charge density.

For obtaining a required magnetic flux density, however, a bulky magnet system is needed. Furthermore, the low voltage oscillation by the klystron is expected no longer when using the increased voltage.

For these reasons, the present invention employs the multi-beam klystron.

Although the perveance of each electron may be decreased where the multi-beam klystron is used, it is possible to improve the efficiency and obtain high output at a low voltage because the perveance of the overall system corresponds to the sum of perveances of individual electrons and, thus, have a large value.

Where the multi-beam klystron is employed, therefore, the microwave oven can operate with a simple magnet system and at a low operating voltage in that the perveance of each electron is maintained at a low level. Simultaneously, the microwave oven can generate a high output in that the perveance of the overall system is maintained at a high level.

The minimum number N of electron beams in the multi-beam klystron corresponds to $(Vom/Vos)^{2/5}$("Vom" is an operating voltage of the multi-beam klystron and "Vos" is an operating voltage of the single beam klystron corresponding to 4 KV). In practical, the number of electron beams in the multi-beam klystron should be determined to satisfy the geometrical arrangement of drift channels (denoted by the reference numeral 600 in FIG. 13). Accordingly, it is preferred that the number of drift channels of the multi-beam klystron is less than 500. For example, where the multi-beam klystron is to operate at an operating voltage of 600 volts, 127 electron beams are needed. For operating the multi-beam klystron at an operating voltage of 400 volts, 337 electron beams are needed.

In accordance with the present invention, the radius of each electron beam 462 is determined to be a predetermined fraction of the radius of each drift channel 600. When the electron beams 462 have the determined radius, they are partially lost in the drift channels 600, thereby causing a loss of energy.

The electron beams 462 are formed as electrons generated from the surface of electron gun 460 are concentrated on points. As these electron beams 462 strike against the collector 490 after passing through the drift channels 600, they disappear.

The electron beams 462 emitted from the electron gun 460 are accelerated by the intensity of the electromagnetic field until they reach the pole piece 470*b*. Thereafter, the electron beams 462 move at a constant velocity.

As mentioned above, the multi-beam klystron splits an electron beam into a plurality of electron beams which have no affect among each other, thereby enabling the electrons to act independently. As a lot of electron beams are provided by the split, the quantity of the charge in each electron beam is relatively decreased. As a result, the repulsion of electrons is not so high even though the electron beams are bunched. It, therefore, is possible to considerably reduce the intensity of electromagnetic field and the voltage of collector 490.

As is apparent from the above description, where the multi-beam klystron is employed in a microwave oven for cooking, the requirement of a high voltage transformer is eliminated. This results in a simpleness in construction and, thereby, a reduction in weight and volume. In place of the high voltage transformer, a simple back-voltage circuit may be used to obtain a voltage of a desired level.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

In particular, although the present invention has been described in conjunction with the microwave oven wherein a stirrer is equipped in the cooking chamber, it can be equivalently applied to a case equipped with a turntable.

The magnets may have an annular shape, although they have been described as having a polygonal shape. Alternatively, the magnets may have a polyhedron lattice shape.

Although not described hereinbefore, spaces through which electron beams pass are kept at a resonation state, as in conventional magnetrons wherein a resonation state is made upon forming an antenna.

What is claimed is:

1. A microwave oven, comprising:

a microwave generator comprising a klystron, a cooking chamber arranged to receive the microwaves from the klystron, control means for actuating the klystron, a wave guide for guiding the microwaves from the klystron to the cooking chamber, a stirrer for dispersing the microwaves introduced into the cooking chamber, a fan for cooling the klystron, and at least one aperture for introducing a wind generated from the fan and exhausted after cooling the klystron into the cooking chamber, said klystron comprising:

an input terminal for receiving electrical power, a klystron body for generating microwaves in response to the supply of electric power to the input terminal, an output unit for transmitting the microwaves out of the klystron body, cooling means for outwardly discharging a heat generated in the klystron body, and an electron collector arranged to receive electrons, the cooling means comprising cooling fins arranged to dissipate heat from the collector generated by the receipt of electrons, a cooling rod arranged to support the cooling fins and transfer heat from the collector to the cooling fins, and an enclosure surrounding the cooling fins.

2. A microwave oven in accordance with claim 1, wherein the cooling rod is brazed to the collector so as to be integral with the collector.

3. A microwave oven in accordance with claim 1, wherein a floor of the cooking chamber includes a turntable.

4. A microwave oven in accordance with claim 1, wherein the klystron further includes an electron producer, a collector for receiving the electrons, and a coaxial line electrically connected to a cavity disposed adjacent the collector for transmitting microwaves from the klystron.

5. A microwave oven, comprising:

a microwave generator comprising a klystron, the klystron including:

an electron gun for producing a plurality of parallel electron beams, a tube forming a plurality of channels for conducting respective ones of the electron beams, and a plurality of cavities spaced apart in the direction of electron flow, the cavities communication with the channels, a last of the cavities arranged for conducting microwaves out of the tube, a collector disposed adjacent the last cavity for receiving the electron beams, a magnet assembly for constraining the electron beams to flow toward the collector, and a cooking chamber arranged to receive the microwaves from the klystron.

6. A microwave oven, comprising:

a microwave generator comprising a klystron, a cooking chamber arranged to receive the microwaves from the klystron, control means for actuating the klystron, a wave guide for guiding the microwaves from the klystron to the cooking chamber, a stirrer for dispersing the microwaves introduced into the cooking chamber, a fan for cooling the klystron, and at least one aperture for introducing a wind generated from the fan and exhausted after cooling the klystron into the cooking chamber, said klystron comprising:

an input terminal for receiving electrical power, a klystron body for generating microwaves in response to the supply of electric power to the input terminal, an output unit for transmitting the microwaves out of the klystron body, and an electron gun disposed in the klystron body for producing an electron flow, a collector disposed in the klystron body for receiving the electron flow, and magnets disposed around the electron gun and collector for restraining the electron flow to travel toward the collector.

7. A microwave oven in accordance with claim 6, wherein the collector is coated with a material exhibiting a high work function.

8. A microwave oven in accordance with claim 6, wherein the magnets have an annular shape.

9. A microwave oven in accordance with claim 6, wherein the magnets have a polyhedron lattice shape.

10. A microwave oven in accordance with claim 6, wherein the magnets are spaced apart in the direction of electron flow so that an electric field created by the magnets extends generally parallel to that direction.

11. A microwave oven in accordance with claim 6, wherein the magnets are spaced apart laterally relative to the direction of electron flow so that an electric field created by the magnets extends generally laterally of that direction.

12. A microwave oven, comprising:

a microwave generator comprising a klystron, a cooking chamber arranged to receive the microwaves from the klystron, control means for actuating the klystron, a wave guide for guiding the microwaves from the klystron to the cooking chamber, a stirrer for dispersing the microwaves introduced into the cooking chamber, a fan for cooling the klystron, and at least one aperture for introducing a wind generated from the fan and exhausted after cooling the klystron into the cooking chamber, said klystron comprising:

an input terminal for receiving electrical power, a klystron body for generating microwaves in response to the supply of electric power to the input terminal, an output unit for transmitting the microwaves out of the klystron body, and an electron gun for generating a plurality of electron beams, and a tube defining a plurality of channels for conducting respective ones of the electron beams.

13. A microwave oven in accordance with claim 12, wherein the number of channels of the tube is less than 500.

14. A microwave oven in accordance with claim 12, wherein each of the channels has a diameter of 0.3 mm to 5 mm.

15. A microwave oven in accordance with claim 12, wherein the tube has a leading end and a trailing end each comprised of a magnetic body capable of obtaining a uniform magnetic flux density in the tube.

16. A microwave oven in accordance with claim 15, wherein each magnetic body is coated with copper.

17. A microwave oven in accordance with claim 12, wherein the tube is made of copper.

18. A microwave oven in accordance with claim 12, wherein the tube further defines from 2 to 8 cavities communicating with the channels.

* * * * *